United States Patent [19]

Crum

[11] 4,181,261

[45] Jan. 1, 1980

[54] SAFETY GUARD FOR AN AIRLESS SPRAY NOZZLE

[75] Inventor: Gerald Crum, Elyria, Ohio

[73] Assignee: Nordson Corporation, Amherst, Ohio

[21] Appl. No.: 887,689

[22] Filed: Mar. 17, 1978

[51] Int. Cl.[2] ..... B05B 11/00

[52] U.S. Cl. ..... 239/288.5; 239/600; 239/DIG. 22

[58] Field of Search ..... 239/288, 288.3, 288.5, 239/DIG. 22, 505, 526, 522, 597, 600, 599

[56] References Cited

U.S. PATENT DOCUMENTS

| | | | |
|---|---|---|---|
| 3,913,844 | 10/1975 | Petrovic | 239/600 |
| 3,944,141 | 3/1976 | Siczek | 239/288.5 |

FOREIGN PATENT DOCUMENTS

| | | | |
|---|---|---|---|
| 2503121 | 8/1976 | Fed. Rep. of Germany | 239/DIG. 22 |

*Primary Examiner*—James B. Marbert

*Attorney, Agent, or Firm*—George J. Coghill

[57] ABSTRACT

An airless liquid spray nozzle is disclosed which has a safety guard extending therefrom in order to prevent the nozzle from coming into close proximity with the skin of a human operator, repairman, or the like. The conduit supplying liquid is valved by a normally closed valve responsive to air pressure or other control medium. The control medium supply communicates with a passage or path in the extending portion of the safety guard. Therefore, if the guard is not attached to the nozzle or becomes substantially broken, air leakage causes the supply of air to the valve to be reduced to such an extent that the valve stops hydraulic flow to the nozzle. In the preferred embodiment, the control medium, e.g. air, is supplied to the normally closed valve through a path or conduit which passes through the extending portion of the guard before reaching the valve.

16 Claims, 8 Drawing Figures

SAFETY GUARD FOR AN AIRLESS SPRAY NOZZLE

FIELD OF THE INVENTION

Present invention relates to airless spray nozzles, and more particularly relates to an improved safety guard for airless spray nozzles.

BACKGROUND OF THE INVENTION

Airless atomization is a well known technique to produce a cloud of small liquid droplets. For example, such a technique is widely used in the spray coating industry to project paint or the like onto a substrate to be coated. Methods of airless atomization are well known. In general, the liquid to be atomized is forced through an orifice under high hydraulic pressures to effect atomization. Pressures may range from a few hundred psi to over 3000 psi.

Because of the high pressures used, there are dangers associated with airless atomization. A primary danger arises from the fact that the liquid being discharged through the orifice at high pressure can be injected into the skin of a human operator, repairman, etc. Not only can the injection be a painful experience, but if not properly treated in a timely fashion the injection might lead to complications such as infections, poisoning, and the like.

It has been found that injection from airless spray nozzles only occurs when the skin is close to the nozzle orifice. Upon discharge the liquid stream breaks up into small droplets very quickly and its velocity is decreased fairly rapidly. Therefore, injection is only a hazard when the skin is in close proximity to the orifice. Recently in the spray coating industry manufacturers of airless spray equipment have made available nozzle guards for use with airless atomizing equipment. Most of the nozzle guards have been designed for airless spray nozzles which produce a flat fan spray pattern. Such a nozzle guard is described in U.S. Pat. No. 3,952,955. In general the guard fits over the nozzle so that it has an end distal from the nozzle extending downstream of the spray pattern. The nozzle guards prevent the skin from coming into dangerously close proximity to the nozzle orifice.

These nozzle guards are effective if properly used and maintained. However, there may be a tendency on the part of operators or repairmen to remove the nozzle guards or leave them off after repair. Some nozzle guards have been made an integral part of the nozzle orifice attaching means, so that the airless nozzle cannot be completely assembled unless the nozzle guard is also used. However, even in this situation the extending portions of the nozzle guard could be cut off or broken through accident to the point where the nozzle guard no longer serves its purpose and the skin of a human operator could come into close enough proximity to result in injection.

The present invention deals with an airless spray system wherein removal or breakage of the nozzle guard will render the system inoperative. The hydraulic supply line to the liquid nozzle is valved by an air-operated normally-closed valve. The air supply to the valve is in communication with air passages in the nozzle guard. Therefore, if the nozzle guard is removed or substantially broken, air leakage will prevent the normally-closed air-operated valve from opening. In the preferred embodiment the nozzle guard has a single continuous air path through it having an inlet and outlet wherein the air supply to operate the control valve passes through the nozzle guard member before reaching the air controlled valve for the liquid supply to the nozzle. Thus, if the nozzle guard becomes broken, the system cannot be made operative merely by plugging the holes where the leakage is occurring. The passage must be completed in order to operate the system. Therefore the most convenient method of making the system operational is to replace the nozzle guard member, rather than by attempting to complete the passage by some other means.

BRIEF DESCRIPTION OF THE DRAWINGS

The invention can be more fully appreciated by reference to the drawing figures in which.

DESCRIPTION OF THE PREFERRED EMBODIMENT

Figure 1:
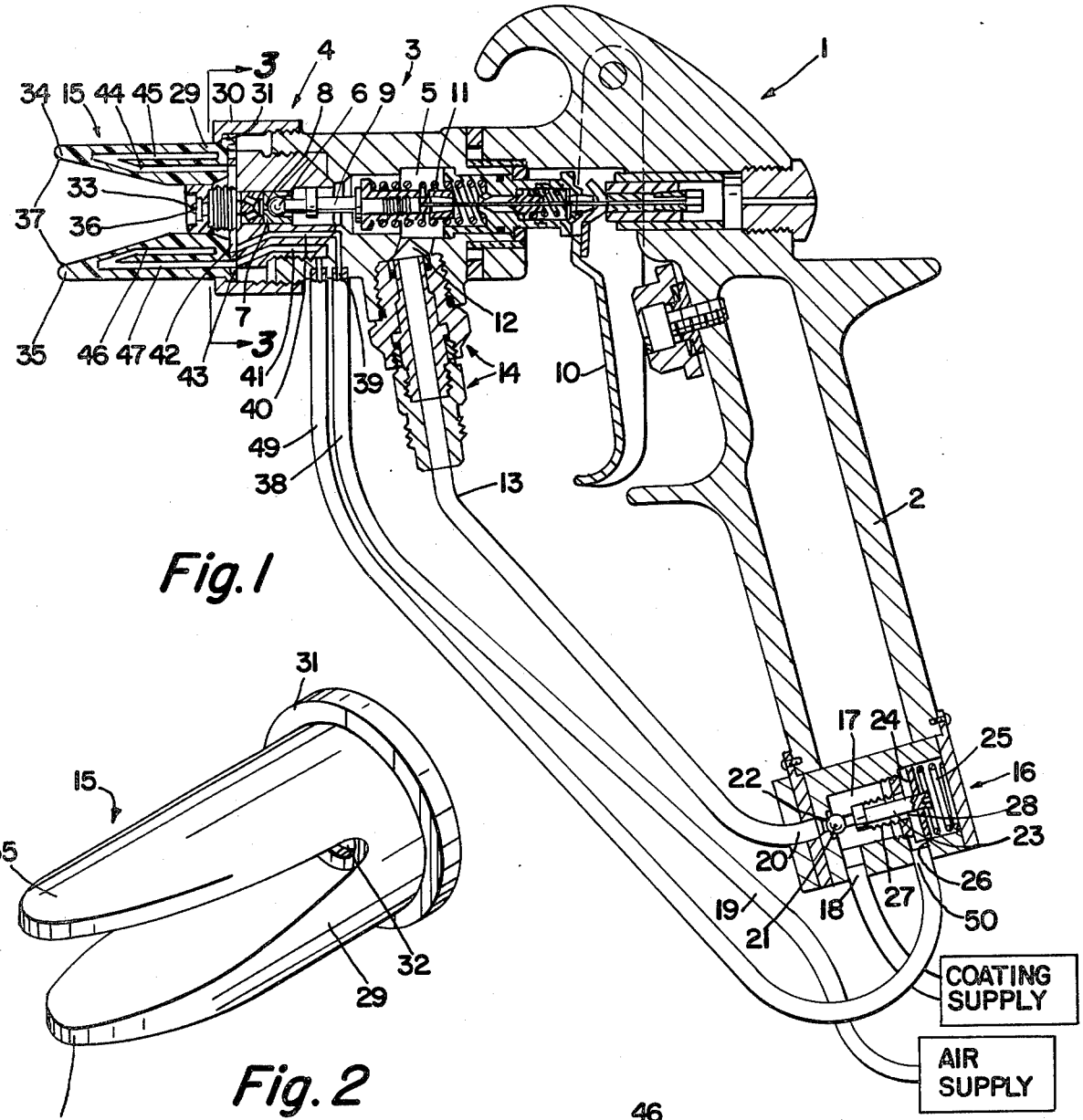
FIG. 1 is a partially cross sectional view of an airless spray gun having a nozzle guard with air passages in it and an air operated valve in the coating supply line.

FIG. 1 depicts a manually-operated airless spray coating gun 1. The gun 1 is typical of airless spray guns widely used in the spray coating industry. In general, it comprises a handle 2 portion, a barrel 3 portion and a nozzle 4 portion. The barrel 3 has a fluid passage 5 which communicates through a ball 6 and seat 7 valve to a fluid passage 8 in the nozzle 4. The ball 6 and seat 7 valve is actuated by means of a pull rod 9 passing through the coating material passage 5 in the barrel 3 from the rear of the gun 1. A trigger 10 pivotally attached to the gun 1 is effective to retract the pull rod 9 in a rearward direction against the action of a spring 11 in order to open the ball 6 and seat 7 valve. Coating material is supplied to the coating material passage 5 in the barrel 3 through an inlet opening 12 in the barrel 3 by means of a suitable hose 13 connected to the opening 12 in the barrel 3 by suitable hydraulic fittings 14. The spray coating gun 1 can be generally like that described in the S. R. Rosen et al. U.S. Pat. No. 3,116,020, assigned to the assignee of the present invention. Therefore, the disclosure of that patent is incorporated herein by reference.

The spray gun 1 of FIG. 1 is different than the spray gun of the referenced patent by the addition of a nozzle guard 15, air passages in the nozzle portion and an air-operated control valve 16 attached to the butt end of gun handle 2 for the coating supply to the gun 1.

The control valve 16 can be any normally-closed hydraulic valve which is opened by means of air pressure. In the particular valve of FIG. 1 coating material enters a liquid chamber 17 in the control valve 16 through an opening 18 in the control valve 16 connected to a supply of liquid coating material (not shown) through a hydraulic supply line 19. The chamber 17 in the valve 16 has an outlet 20 which is attached by a suitable hydraulic hose 13 to the inlet 12 of the coating material passage 5 in the barrel 3 portion of the gun 1. The outlet of the valve 16 is controlled by a ball 21 and seat 22 actuated by a pull rod 23. The pull rod 23 is attached to an air piston 24 and is biased closed by means of a spring 25 urging against the piston 24. The valve 16 is only opened when there is sufficient air pressure supplied to an air chamber 26 acting on the piston 24 to pull the ball 21 off the seat 22. The air chamber 26 and liquid chamber 17 are sealed by means of a steel bellows 27 brazed at one end to the outer portion of the pull rod 23, and at the other end to the periphera of an opening 28 into the liquid chamber 17 for the pull rod 23. Thus, the coating supply line 19 to the coating material passage 5 in the barrel 3 is valved closed unless air pressure is supplied to the air chamber 26 to move the piston 24 against the action of the spring 25.

Air to the control valve 16 must pass through the nozzle 4 portion of the gun 1 and the nozzle guard 15 in order to open the control valve 16.

Figure 2:
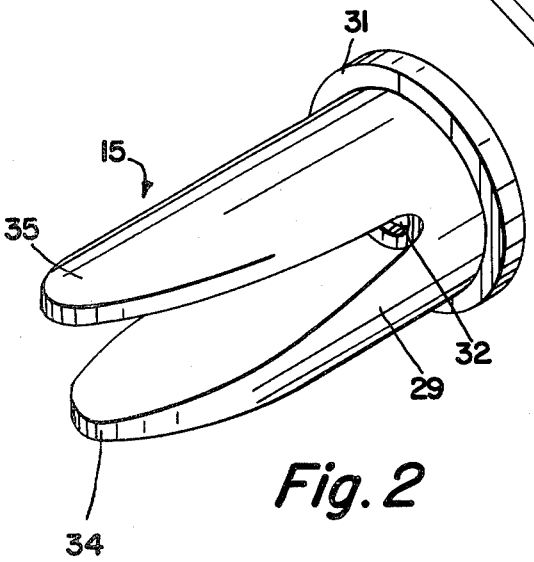
FIG. 2 is a perspective view of the nozzle guard in FIG. 1.
Figure 3:
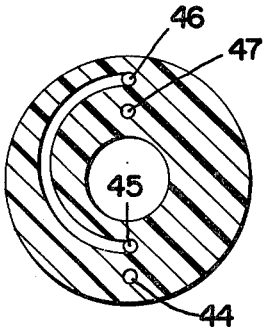
FIG. 3 is a cross sectional view of the nozzle guard of FIG. 1 taken along lines 3—3.
Figure 8:
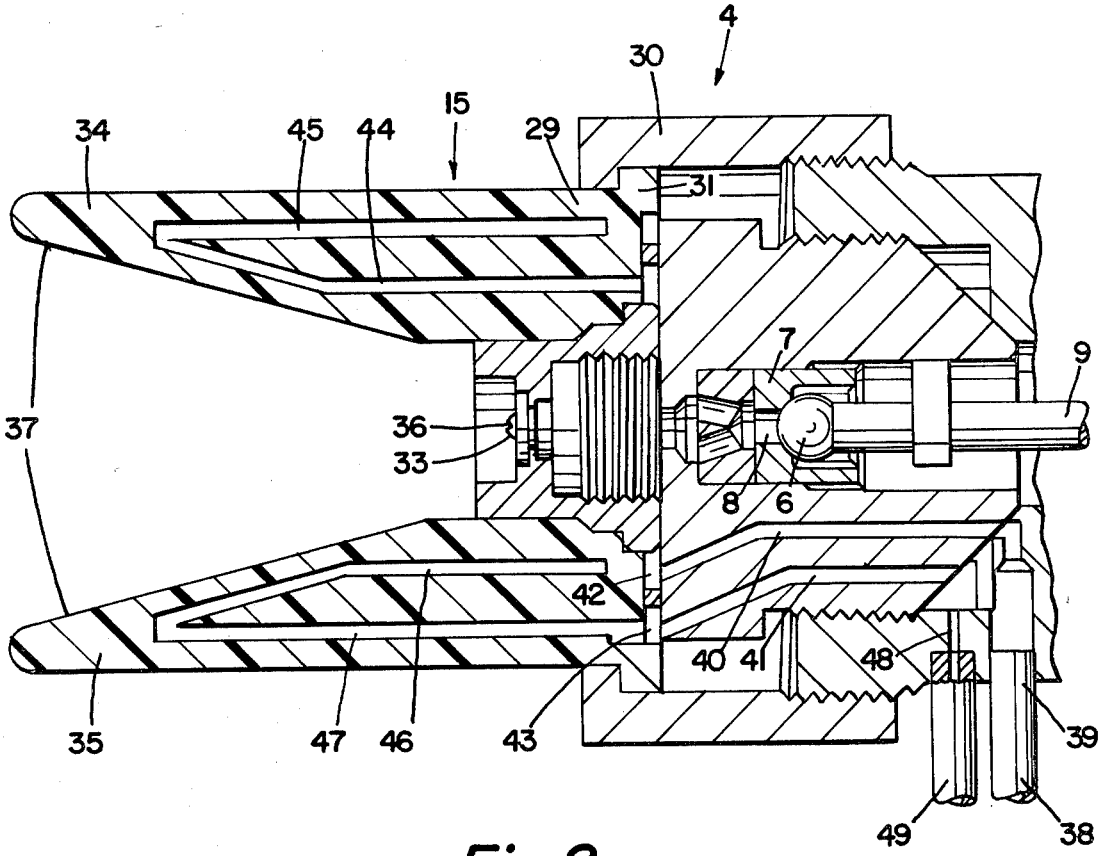
FIG. 8 is an enlarged, partially cross-sectional view of the nozzle portion of the spray gun of FIG. 1.

By combined reference to FIGS. 1, 2 and 8 the general configuration of the nozzle guard 15 can be observed. Its surface configuration is typical of nozzle guards presently being used in the spray coating industry for airless spray guns. The nozzle guard 15 comprises a base or attaching portion 29 which is attached to the nozzle 4 of an airless spray gun 1 by a suitable retaining nut 30 which engages a flange 31 surrounding the base portion 29 of the guard 15. A hole 32 is provided centrally of the base portion 29. The hole 32 receives the nozzle tip 33 of an airless spray gun 1.

The nozzle guard 15 has two projecting portions 34, 35 extending from the base 29 of the guard 15 in the direction of the spray pattern. Because most airless spray guns used in the coating industry produce a flat fan spray pattern, the extending portions 34, 35 are not joined, but rather are separated so as to provide clearance for the flat fan pattern of a spray nozzle 4. The projecting portions 34, 35 are located adjacent to fluid discharged from the nozzle 4, proximate the discharge opening 36. The distal end 37 of the projecting portions 34, 35 of the guard 15 generally extend far enough so that the liquid being discharged from the nozzle 4 has broken up sufficiently by the time it reaches the distal end 37 of the projections 34, 35 so that injection is not possible.

Air is supplied through a suitable hose 38 to an inlet opening 39 to the nozzle portion 4 of the gun 1. The opening 39 communicates with a first air passage 40 in the nozzle portion 4 which leads to a first annular air chamber 42 encircling the spray nozzle 4 which is centrally located at the front of the gun 1. This first annular chamber 42 communicates with a first air passage 44 in the nozzle guard 15. This first air passage 44 extends substantially to the distal end 37 of the first projecting extension 34 of the nozzle guard 15 and thereafter continues through a second air path 45 backwardly toward the attaching end 29 of the guard 15. The second air passage 45 does not extend to the rear surface of the nozzle guard 15 but rather branches through the base portion 29 of the nozzle guard 15 to communicate with a third air passage 46 in the second projecting portion 35 of the guard 15. This third air passage 46 extends substantially to the distal end 37 of the second extending portion 35 of the guard 15 and thence continues backwardly toward the rearward attaching portion 29 of the guard 15. This fourth passage 47 communicates with a second annular air chamber 43 surrounding the nozzle 4. This chamber 43 communicates by means of a second air passage 41 in the nozzle portion 4 to an outlet opening 48 through the sidewall of the barrel 3. This outlet 48 is in turn connected by means of a suitable hose 49 to an air inlet 50 of the normally-closed control valve 16. Thus, it can be appreciated that unless the nozzle guard 15 is properly attached to the gun 1 and in a substantially unbroken condition, insufficient air pressure will be supplied in closed-feed relationship to the inlet 50 of the normally-closed air-operated control valve 16, and hence the liquid coating supply line 13 to the gun is valved closed. Air pressure at the air inlet 50 of the control valve 16 will not be great enough to operate the valve 16.

A further characteristic of this embodiment is the fact that if the guard 15 is broken or cut, the control valve 16 cannot be made operational merely by plugging the exposed air passages. In this embodiment the passages must be rejoined. Therefore it is easier to replace the nozzle guard 15 than it is to attempt to rejoin the passages in some other fashion.

Figure 4:
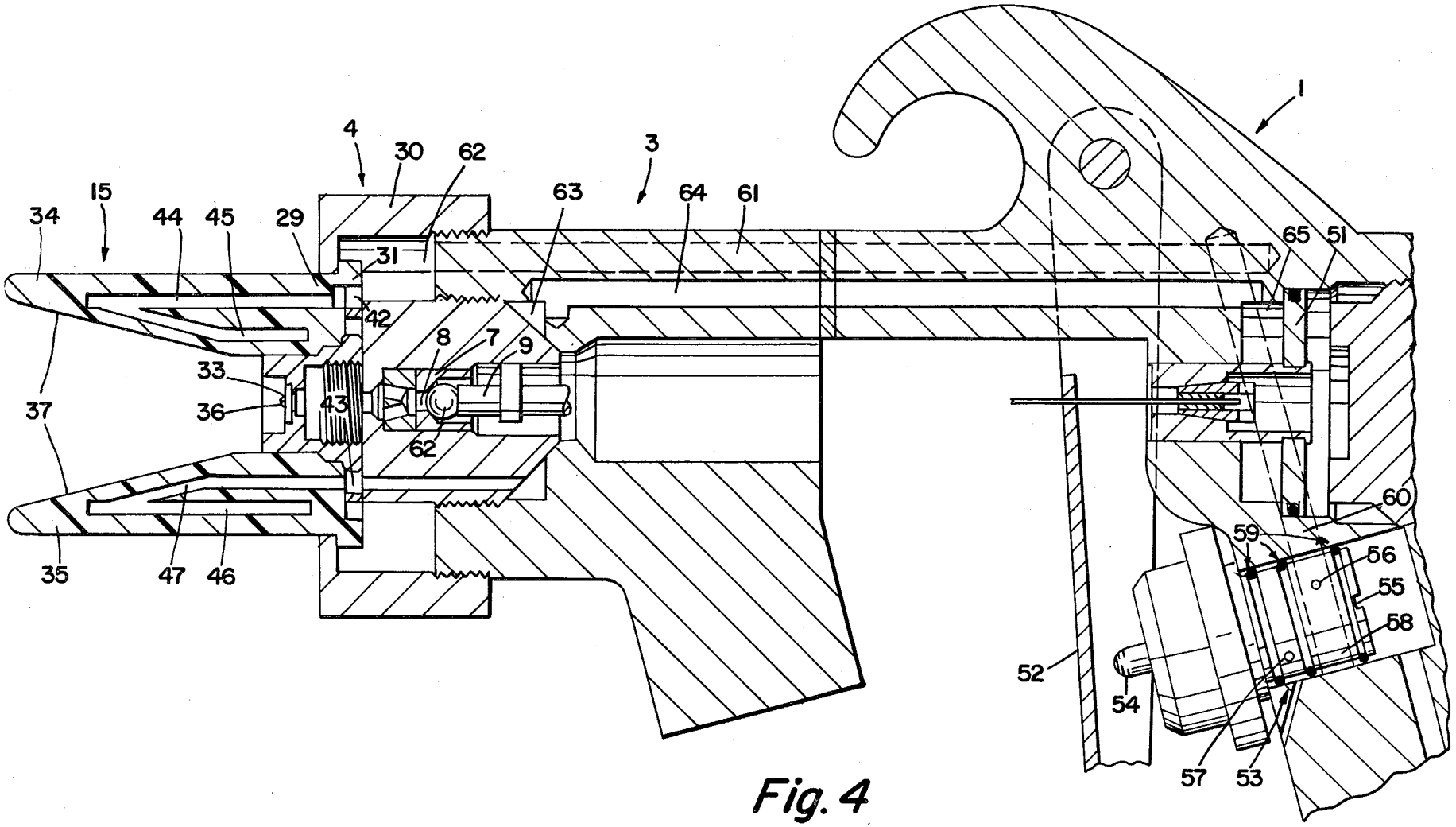
FIG. 4 is an alternate embodiment of the spray gun of FIG. 1 having an air-actuated pull rod.

FIG. 4 depicts an alternate embodiment of the invention wherein the pull rod 9 for the ball 6 and seat 7 valve in the nozzle portion 4 of the gun 1 is actuated by an air piston 51. In this embodiment an air valve 53 is mounted in the handle 2 portion of the gun so that rearward movement of the trigger 52 is effective to depress a plunger 54 of the valve 53. The valve 53 has an inlet port 55, outlet port 56 and vent port 57. When the plunger 54 is depressed, the inlet port 55 and outlet port 56 are connected so that air passes from the inlet 55 to the outlet port 56. When the plunger is not depressed the outlet port 56 and vent port 57 are connected so as to vent the outlet port 56 to atmosphere and to block the inlet port 55. Any suitable commercially available valve can be employed for this valve 53 in the handle 2. Air is supplied through the handle 2 to an inlet air chamber 58 in communication with the inlet port 55 of the valve 53. The outlet port 56 of the valve 53 communicates with a chamber 58 surrounding the valve 53 and sealed by means of o-rings 59. This chamber 58 communicates with an air passage 60 behind the plane of the figure, (shown in phantom lines) which passage 60 in turn communicates with an air passage 61 in the barrel 3 portion also behind the plane of the figure (shown in phantom lines). This air passage 61 in the barrel 3 also communicates with a first annular air chamber 42 in the nozzle 4 portion of the gun 1, as in the embodiment of FIG. 1. The nozzle guard structure and air passages in the nozzle portion of this embodiment are substantially identical to those of FIG. 1. The fourth air passage 47 in the nozzle guard 15 communicates with a second annular air chamber 43 at the forward end of the nozzle 4. This second air chamber 43 communicates by means of a passage 62 to a third annular air chamber 63 rearward of the nozzle portion 4. This third chamber 63 in turn communicates with a return air passage 64 in the barrel 3 and thence communicates with an air chamber 65 partially formed by a movable piston 51 biased in a forward position by a spring (not shown). The piston 51 is connected to the pull rod 9 for the valve in the nozzle 4 portion of the gun 1. The pull rod 9 is retracted by movement of the piston 51 in a rearward direction caused by air pressure in the air chamber 65. Thus, air must be supplied through the nozzle guard 15 to the piston chamber 65 in order to actuate the valve.

Figure 5:
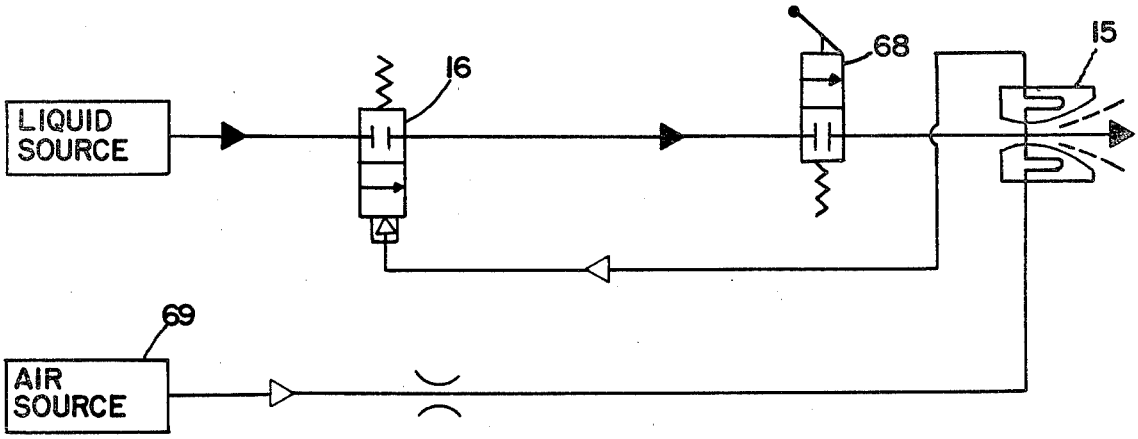
FIG. 5 is a schematic diagram of the liquid and air system of the gun of FIG. 1.

FIG. 5 represents a schematic diagram of the liquid and air system for the gun of FIG. 1. As shown, a supply of liquid under high pressure is supplied through a normally-closed control valve 16 and thence through a normally-closed manually-operated valve 68 representing the ball 6 and seat 7 valve at the nozzle portion 4 of the gun 1. From there it is supplied to the spray nozzle 4. Air must be supplied to the control valve 16 in order to open it. Air is supplied from a source of air 69 to the air passages passing through the nozzle guard 15 and thereafter to the air inlet port 50 of the control valve 16.

Figure 6:
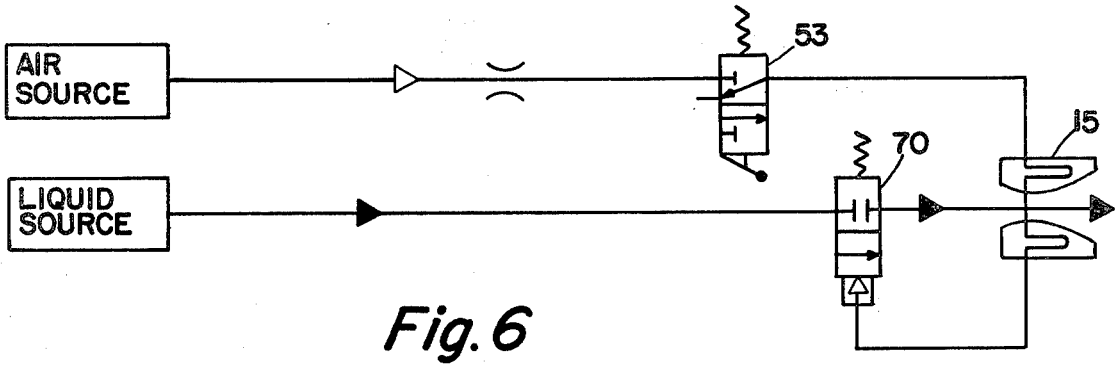
FIG. 6 is a schematic view of the liquid and air systems of the gun of FIG. 4.

FIG. 6 represents a schematic diagram of the air and liquid systems in the gun of FIG. 4. Liquid is supplied under high pressure from a liquid source to an air-operated normally-closed valve 70, and thereafter to the spray nozzle 4. Surrounding the spray nozzle 4 is a nozzle guard 15. A source of air 69 supplies air through the passages in the nozzle guard 15 and thereafter to a manually-operated normally-closed air valve 53. The manually-operated air valve 53 is effective to pass air to an outlet port 56 when actuated, and to vent the outlet port 56 to atmosphere in its normal position. The outlet port 56 of the air valve 53 is connected to an air inlet for an air-operated normally-closed hydraulic valve 70, representing the air piston/ball-and-seat valve in the gun 1 of FIG. 2.

Figure 7:
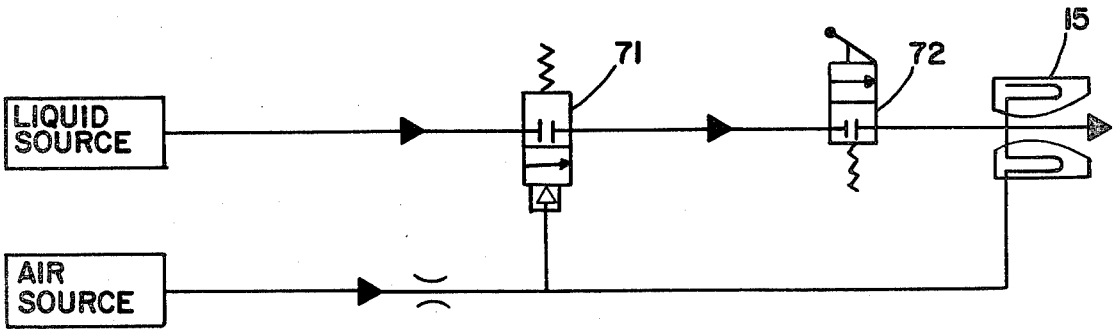
FIG. 7 is a schematic diagram of a third alternative embodiment of the spray gun of FIG. 1.

FIG. 7 depicts a schematic diagram of a third alternative embodiment of the invention. FIG. 7 shows fluid being supplied under high hydraulic pressure through a normally-closed air-operated hydraulic valve 71 and thence to a manually-operated normally-closed hydraulic valve 72 and thereafter to the spray nozzle 4. This embodiment is similar to that depicted in FIG. 1, however the significant difference is that the air supplied to operate the air-actuated hydraulic valve 71 merely has a branch line also in closed-feed relation to air passages in the nozzle guard 15. Hence, the significant difference is that the nozzle guard 15 does not have the control air path through the nozzle guard 15. In this embodiment, if the nozzle guard 15 is removed or broken, air leakage would reduce the air pressure to such an extent that the air-actuated hydraulic valve 71 would not open. However, in this embodiment if the nozzle guard 15 were broken, the system could be made operational merely by plugging the exposed passage. Therefore, in this embodiment, although beneficial to a conscientious operator, could be defeated more easily than the system of the preferred embodiment.

It is to be noted that in all the embodiments described herein, the control medium used was air. Air was chosen for the preferred embodiment because it is a conveniently available control medium for many applications, and does not have certain dangers associated with it that electricity might have.

It is noted however that other control mediums such as electricity or liquid could be used as the control medium. The invention is readily adaptable to such control mediums.

Also, it is noted that the use of air would allow the use of a portable air source or other gas source such as $CO_2$ cartridges similarly as a battery might be used if the control medium were electricity. Such portable control medium sources could be mounted onto the gun or the valve assembly.

Having described my invention, I claim:

1. An airless spray coating apparatus comprising:

a nozzle portion having a discharge opening effective to discharge fluid therefrom;

a hydraulic conduit communicating with said nozzle portion to supply fluid under pressure to said discharge opening of said nozzle portion;

a safety guard proximate the discharge opening of the nozzle portion;

control means responsive to a fluid control medium supply and effective to disable said pressurized supply of fluid to said nozzle portion when said safety guard is significantly broken.

2. An airless spray coating apparatus comprising:

a nozzle portion having discharge opening effective to discharge fluid therefrom;

a hydraulic conduit communicating with said nozzle portion to supply fluid under pressure to said discharge opening of said nozzle portion;

a safety guard adjacent the discharged fluid proximate the discharge opening;

control means responsive to a fluid control medium supply and effective to disable the pressurized supply of fluid to said nozzle portion when said control medium supply is reduced below a pre-determined level; and means in said safety guard to reduce said control medium supply below said pre-determined level if said safety guard is significantly broken or removed.

3. An airless spray coating apparatus comprising:

a nozzle portion having a discharge opening effective to discharge fluid therefrom;

a hydraulic conduit communicating with said nozzle portion to supply fluid under pressure to said discharge opening of said nozzle portion;

a safety guard adjacent a portion of the discharged fluid proximate the discharge opening;

a valve for said hydraulic conduit;

valve actuating means responsive to a control medium supply and effective to open said valve only when said control medium supply is greater than a pre-determined level;

a control medium supply line in closed-feed communication with said valve actuating means; and means in said safety guard in communication with said control medium supply line to reduce the control medium supply line below said pre-determined level if said safety guard is significantly broken or removed.

4. An airless spray coating apparatus comprising:

a nozzle portion having a discharge opening effective to discharge fluid therefrom;

a hydraulic conduit communicating with said nozzle portion to supply fluid under pressure to said discharge opening of said nozzle portion;

a safety guard adjacent a portion of the discharged fluid proximate the discharge opening;

a valve for said hydraulic conduit;

valve actuating means responsive to a control medium supply and effective to open said valve only when said control medium supply is greater than a pre-determined level; and a control medium supply line in closed-feed communication with said valve actuating means;

wherein the control medium supply line passes through said safety guard before reaching said control means, such that said control medium supply line is not in closed-feed communication with said control means if said safety guard is significantly broken or removed.

5. The apparatus of claim 3 which further comprises a self-contained portable control medium supply.

6. An airless spray coating apparatus comprising:

a nozzle portion having a discharge opening effective to discharge fluid therefrom;

a hydraulic conduit communicating with said nozzle portion to supply fluid under pressure to said discharge opening of said nozzle portion;

a safety guard on said nozzle portion and having a projecting portion adjacent fluid being discharged from said opening, said safety guard further having air passages internal to said projecting portion of said guard;

a normally-closed air-operated valve for said hydraulic conduit;

an air line in communication with said air-operated valve, and in communication with said air passage in said guard.

7. The apparatus of claim 6 wherein said air passage in said guard extends to approximately the end of said projecting portion.

8. An airless spray coating apparatus comprising:

a nozzle portion having a discharge opening effective to discharge fluid therefrom;

a hydraulic conduit communicating with said nozzle portion to supply fluid under pressure to said discharge opening of said nozzle portion;

a safety guard on said nozzle portion and having a projecting portion adjacent fluid which is discharged from said opening, said safety guard further having an air passage internal to said guard, said air passage having an inlet and outlet;

a normally-closed air-operated valve for said hydraulic conduit; and an air line having a first end adapted to be connected to a source of pressurized air and a second end in communication with said air-operated valve through said air passage in said guard;

wherein a substantial breakage of said projecting portion, or removal of the guard from the nozzle will be effective to de-pressurize said air operated valve.

9. The apparatus of claim 8 wherein the projecting portion of the guard has bores in communication with the air passage, said bores extending to the end of said guard projections, distal to the discharge opening of said nozzle portion.

10. The apparatus of claim 9 which further comprises a portable self-contained air supply in communication with said first end of said air line.

11. The apparatus of claim 8 wherein said air passage in said guard comprises a single flow path extending from said inlet into approximately the end of said projecting portion of said guard, and thereafter to said outlet.

12. The apparatus of claim 8 wherein said guard comprises:

first and second projecting portions adjacent fluid discharged from said nozzle portion, wherein said air passage extends from said inlet first to the end of one of said projecting portions of said guard, and thereafter to the end of the second projecting portion before reaching said outlet.

13. A method of spraying comprising:

supplying pressurized fluid to the discharge orifice of an airless spray nozzle through a conduit, said nozzle being equipped with a safety guard having one end distal to said orifice;

valving said fluid in said conduit by a normally-closed valve responsive to a control medium;

opening said valve by means of a control medium supplied to said valve by means of a control medium path;

automatically reducing said control medium supply low enough to close said valve whenever said guard is substantially broken or unattached.

14. The method of claim 13 which further comprises the step of communicating said control medium supply to passages in said guard.

15. The method of claim 14 wherein said passages in said guard extend to the distal end of said guard.

16. The method of claim 13 which further comprises the step of flowing the control medium supply through a passage in said guard proximate the distal end of said guard before it reaches said valve, whereby said valve closes whenever said guard is unattached or substantially broken.

* * * * *